US005472552A

United States Patent [19]

Speranza et al.

[11] Patent Number: 5,472,552

[45] Date of Patent: Dec. 5, 1995

[54] HIGH SPEED LABELING MACHINE

[75] Inventors: Philip Speranza, Dover; Ronald E. Snyder, York, both of Pa.; Robert C. Jenness, Jr., Westminster, Md.

[73] Assignee: Exact Packaging, Inc., New Freedom, Pa.

[21] Appl. No.: 131,637

[22] Filed: Oct. 5, 1993

[51] Int. Cl.[6] ..... B65C 9/42

[52] U.S. Cl. ..... 156/351; 156/361; 156/363; 156/542

[58] Field of Search ..... 156/542, 361, 156/351, 362, 363, 541; 242/75.3, 419.7

[56] References Cited

U.S. PATENT DOCUMENTS

| | | | |
|---|---|---|---|
| 3,238,080 | 3/1966 | Schluter | 156/351 |
| 3,321,105 | 5/1967 | Marano . | |
| 3,608,808 | 9/1971 | Wolf et al. | 242/75.3 X |
| 3,806,395 | 4/1974 | FRX . | |
| 3,984,277 | 10/1976 | French et al. . | |
| 4,046,613 | 9/1977 | Kucheck et al. . | |
| 4,191,607 | 3/1980 | Cope . | |
| 4,435,243 | 3/1984 | Azeez et al. | 156/361 |
| 4,518,450 | 5/1985 | Warmann . | |
| 4,595,447 | 6/1986 | Lindstrom . | |
| 4,612,079 | 9/1986 | Ostrow . | |
| 4,624,734 | 11/1986 | Voltmer et al. . | |
| 4,707,212 | 11/1987 | Hailey et al. | 156/574 X |
| 4,763,823 | 8/1988 | Eder et al. . | |
| 4,822,442 | 4/1989 | Ashcraft et al. . | |
| 4,842,660 | 6/1989 | Voltmer et al. | 156/362 X |
| 5,022,954 | 6/1991 | Plaessmann . | |
| 5,133,827 | 7/1992 | Ratermann . | |
| 5,230,765 | 7/1993 | Weiselfish et al. | 156/542 X |

*Primary Examiner*—Mark A. Osele

*Attorney, Agent, or Firm*—Sixbey, Friedman, Leedom & Ferguson; Tim L. Brackett, Jr.

[57] ABSTRACT

A high speed labeling machine for dispensing labels from a continuous web of backing material having labels affixed thereto and applying the labels to a plurality of articles is provided. The labeling machine includes a supply station positioned adjacent a conveyor and a dispensing device and applicator assembly mounted on a support carriage mounted on a support arm and capable of high speed transverse movement across the conveyor for labeling articles positioned in a side by side arrangement. The continuous web of material is fed to the movable support carriage via a follower carriage mounted on the support arm which moves relative to the support carriage so as to maintain tension in the web traveling to and from the support carriage and associated dispensing and applicator devices. As a result, the dispensing device and applicator device can be moved relative to the supply station at high speed without dispensing labels, while at the same time maintaining tension in the web. The supply station is also movably mounted and may be automatically controlled to move longitudinally along the conveyor simultaneous with the transverse movement of the support carriage, thereby allowing the dispensing device and applicator to move through a variety of paths above the articles to permit a multitude of articles in a variety of arrangements to be quickly and effectively labeled. The labeling machine may also include a take-up device for accumulating the waste backing material including a pivotable link biased to apply controlled tension to the web of material.

26 Claims, 6 Drawing Sheets

HIGH SPEED LABELING MACHINE

TECHNICAL FIELD

This invention relates generally to an improved high speed labeling machine capable of dispensing and then applying labels to a plurality of products at high speeds while ensuring accurate and effective placement of the labels.

BACKGROUND OF THE INVENTION

The application of labels to articles and products has been and continues to be an important step in providing product identification, specific product information and marketing advantages. Manufacturers of various products are continually seeking a more efficient and effective manner in which to apply labels to articles or items, such as cartons, containers or any other packages or products having a surface capable of securely receiving an adhesive label.

Numerous methods have been employed in the past to mark articles, such as color-coded ink sprays and manually applied stickers. The introduction of adhesive-backed pressure sensitive labels and hand-held, manually operated applicators has greatly facilitated the marking of articles in that the applicators provide a simple means for applying an adhesive-backed label to an article. Such hand-held label applicators are well known and used extensively in various industries, for example, for marking the price of articles to be sold. Their use, however, in manufacturing, assembling and distributing applications is limited because of the necessity for marking many items at a high rate of speed. In these applications, the articles to be labeled are transported along a conveyor past a number of stations, one of which often entails the application of a label to each article as it passes by or while the conveyor is stopped. Use of a hand-held label applicator in this type of high speed operation would be unacceptably slow, inefficient, labor intensive and therefore, impractical due to the time constraints associated with high volume production.

As a result, relatively high speed labeling machines have been developed to apply labels to articles advancing by a labeling station on, for example, a conveyor belt. The pressure-sensitive labels are commonly precut and carded on a continuous web of material often called backing material which is rolled into a roll for mounting on the labeling machine. The backing material is somewhat more flexible than the label itself. This allows the label to be separated from the backing material simply by bending the backing material sharply away from the label, which is usually done by a drawing the backing over an fairly sharp stripping or peeling edge of a peeling bar or plate. The less flexible label then separates from the backing material and remains relatively straight for application to the article by some type of applicator. For example, U.S. Pat. Nos. 3,984,277 to French et al. and 3,806,395 to French disclose label machines for positioning by a conveyor belt which use a vacuum-blow type applicator having a label receiving surface with openings formed therein. A vacuum-blow control valve is used to create a vacuum on the receiving surface of the applicator causing the label dispensed from the peeler bar to be held against the receiving surface by vacuum pressure. Once an article is moved into position below the label, the vacuum-blow air valve operates to provide a blast of air through the openings thereby blowing the label onto the article. However, these labeling machines do not permit the applying position of the label on the package to be easily varied. In order to change the applying position of the label relative to the article, these machines require repositioning of the article on the conveyor belt relative to the labeling machine and/or manually repositioning the entire labeling machine. Moreover, there are many instances in which it is desirable, more efficient, or simply necessary to label articles arranged in a side by side relationship on a conveyor transverse to the feed path of the articles. For example, some assembly or manufacturing stations upstream of the labeling station discharge articles in a side by side arrangement across the conveyor. However, the machines disclosed in French '395 and French et al. '277 must receive articles conveyed in a single row along the feed path on the conveyor to allow the applicator to apply the label to each article and, therefore, these machines are incapable of quickly and effectively labeling a transverse row of articles.

Another type of labeling machine includes the use of a movable applicator assembly for acquiring a label from a peeler bar, moving transversely across the conveyor away from the peeler bar and applying the label to the article. Various embodiments of this type of labeling machine are disclosed in U.S. Pat. Nos. 4,191,607 to Cope, 4,595,447 to Lindstrom, 4,612,079 to Ostrow and 4,822,442 to Ashcraft et at. Since the applicator assembly of these machines may be moved away from the peeler bar to a variety of locations transverse to the conveyor while carrying the dispensed label, these machines do not depend entirely on the position of the article for accurate placement of the label. However, it has been found that during movement of the applicator assembly from the dispensing position, in which a label is dispensed onto the receiving surface of the applicator, to the applying position adjacent the article, the label often inadvertently moves relative to the receiving surface due to machine vibration, abrupt movements and inertial and wind forces acting on the label. This inadvertent movement of the label during movement of the applicator assembly is even more probable in high speed operations and results in unpredictable positioning and orientation of the label on the article. Consequently, the location and orientation of the label on the article may be undesirable and even unacceptable. Moreover, these types of machines require the applicator assembly to move through a delivery stroke from the peeler bar and a return stroke back to the peeler bar for each dispensed label thereby expending a significant amount of operating time for each label. This unnecessarily large amount of operating time per label makes it more difficult to obtain the high speed labeling desired in present applications.

U.S. Pat. No. 4,046,613 to Kucheck et al. discloses a labeling machine having a label applicator capable of applying labels to articles arranged in a side by side arrangement across a conveyor. This machine uses a revolving belt having a vacuum-blow type receiving surface positioned across the article conveyor belt for receiving the labels in sequence from a peeler bar positioned adjacent the article conveyor belt and then applying the labels to respective articles. The machine also includes a fine positioning means including various retractable pins operated by individual air cylinders which act as stops for respective labels positioned on the receiving surface. However, since the labels are moved through a relatively large distance after being dispensed from the backing material by the peeler bar located adjacent the article conveyor belt, a significant opportunity for inadvertent movement of the label on the belt exists even with the use of the vacuum surface. Moreover, the fine positioning means is undesirably complex and appears to require inconvenient manual adjustment when the position of the article is changed in order to maintain this fine positioning control. In addition, this machine does not provide for automatic longitudinal movement of the applicator assembly along the feed path of the articles during operation of the labeling machine as may be desirable in order to label an array of articles positioned on a conveyor.

U.S. Pat. No. 5,133,827 to Ratermann discloses a labeling machine wherein the dispensing means (peeler bar) and applicator means are mounted with the supply roll of labels on an arm overhanging the conveyor. This design allows the whole overhanging assembly to be moved transversely to position the dispensing means immediately adjacent each article, thus avoiding the disadvantages of carrying a dispensed label a relatively large distance to the article. However, this design does not appear to permit labeling of articles positioned in a side by side arrangement across the conveyor since the applicator means relies on the movement of the article to assist in applying the label and only one label may be applied at a time. Moreover, a large number of components, such as the supply roll, the driver roll and associated motor for pulling the web of labels from the roll, and various idler rollers are all mounted on the movable labeling assembly which transverses the conveyor. As a result, the movable labeling assembly is much heavier than necessary, requiring a stronger, more durable support structure. Also, the large weight of the movable labeling assembly creates high inertia requiring more powerful operating components while making high speed operations more difficult.

U.S. Pat. No. 4,518,450 to Warmann discloses an automatic labeling machine including a dispensing assembly movably positioned over the conveyor for applying the label to an article. However, the movable dispensing assembly includes the supply of labels and is, therefore, large and heavy. Moreover, this machine moves the label a substantial distance after it has been dispensed from the backing material, and, therefore, does not solve the problems of the prior art as discussed hereinabove.

U.S. Pat. No. 4,624,734 discloses a labeling machine which separates the dispensing station from the supply station using a guide leg extending from a stationary supply station including a supply roll positioned adjacent the conveyor. An articulated dispensing head connected to the outer end of the guide leg, a spaced distance from the supply station, dispenses a label from a continuous web of labeling material fed to the dispensing head from the supply roll. The empty backing strip then travels back to a waste roll mounted at the supply station. This arrangement permits the installation of the dispensing head into a confined region on the packaging line. However, this machine is not capable of labeling articles arranged in a side by side manner across the conveyor since the guide arm and articulated head do not move transversely.

SUMMARY OF THE INVENTION

It is an object of the present invention, therefore, to overcome the disadvantages of the prior art and to provide a labeling machine capable of accurately and effectively applying labels to articles at a very high speed.

It is another object of the present invention to provide a labeling machine capable of automatically, sequentially yet effectively, labeling a large number of articles positioned in various arrangements on a conveyor.

It is yet another object of the present invention to provide a high speed labeling machine which allows the application of labels to articles positioned across a conveyor in a side by side arrangement.

It is a further object of the present invention to provide a high speed labeling machine which permits the movement of the dispensing means relative to the supply roll into various applying positions adjacent a respective articles.

It is a still further object of the present invention to provide a labeling machine which permits movement of the dispensing means toward and away from the supply station without requiring a label to be dispensed.

Still another object of the present invention is to provide a labeling machine which permits movements of the dispensing means simultaneous with the movement of the applicator means.

Yet another object of the present invention is to provide a labeling machine which allows the dispensing of a label while the applicator and dispensing means move into an applying position.

A further object of the present invention is to provide a labeling machine which permits the applying position of the label to be easily varied.

Yet another object of the present invention is to provide a labeling machine for minimizing the distance required to move a dispensed label into an applying position adjacent an article.

It is yet another object of the present invention to provide a high speed labeling machine capable of minimizing the total time and distance necessary for the movable dispensing and applicator assembly to dispense and apply each label.

Another object of the present invention is to provide a labeling machine which minimizes the weight and size of the movable dispensing and applicator assembly while permitting automatic transverse movement of the assembly across the conveyor, thereby, minimizing the negative effects of inertia and, thus, permitting high speed operation.

Still yet another object of the present invention is to provide a high speed labeling machine capable of effectively maintaining the proper amount of tension in the continuous web of labeling material to effect proper dispensing.

A further object of the present invention is to provide a high speed labeling machine capable of maintaining the required tension in the continuous web of material throughout the movement of the peeler bar and applicator.

Still another object of the present invention is to provide a high speed labeling machine which minimizes the required tension force supplied to the web of backing material necessary for dispensing each label.

Another object of the present invention is to provide a high speed labeling machine capable of minimizing the frictional forces applied to the web by the peeler bar while insuring effective label dispensing.

Yet another object of the present invention is to provide a high speed labeling machine having a take-up assembly which efficiently accumulates the waste backing material while assisting in moving the web through the machine.

These and other objects are achieved by providing a high speed labeling machine for dispensing labels from a continuous web of backing material and applying the labels to a plurality of articles, comprising a supply station having a supply roll of backing material with labels affixed thereto, a driver roller for pulling the continuous web of material from the supply roll, a dispensing device, such as a peeler bar, positioned a spaced distance from the supply roll for removing a label from the continuous web of backing material for application to the article, and an applicator device, such as a vacuum-blow applicator assembly, positioned adjacent the dispensing device for applying the label to the article, a positioning means for moving the dispensing device during operation of the machine into an applying position adjacent the article, wherein the positioning means can be operated to move the dispensing device during operation of the labeling machine to vary the spaced distance between the supply roll and the dispensing device. The applicator device may be connected to the dispensing device to create one movable assembly. The positioning means is capable of automatically sequentially positioning the dispensing device and applicator device into a plurality of applying positions relative to the articles. The positioning means may include a support arm and a support carriage mounted on the support arm for movement along a first positioning path generally transverse to the feed path of the articles. The applicator device and dispensing device are mounted on the support carriage for transverse movement across the conveyor belt conveying the articles to be labeled. The positioning means may also include a follower carriage movably mounted on the support arm at the supply station. The positioning means may be operable to move the support carriage a first distance along the first positioning path and the follower carriage a second distance along the first positioning path wherein the second distance is less than the first distance. A driving means may be positioned adjacent the supply station and may include a driver roller and a nip roller biased toward the driver roller so as to contact the continuous web of material supported by the driver roller. A take-up means may be provided for accumulating the web after the labels have been dispensed while also assisting in pulling the web through the label machine. The take-up means may include a pivotable link having one end pivotable between first and second positions and including a link roller for supporting the web. A biasing device such as an air cylinder rod may be used to bias the first end of the pivotable link toward the second position thus tensioning the continuous web of material. A take-up drum may be provided to receive the continuous web of backing material without the labels from the link roller. The take-up drum may be operable to move the end of the pivotable link from the second position to the first position.

DETAILED DESCRIPTION OF THE PREFERRED EMBODIMENT

Figure 1:
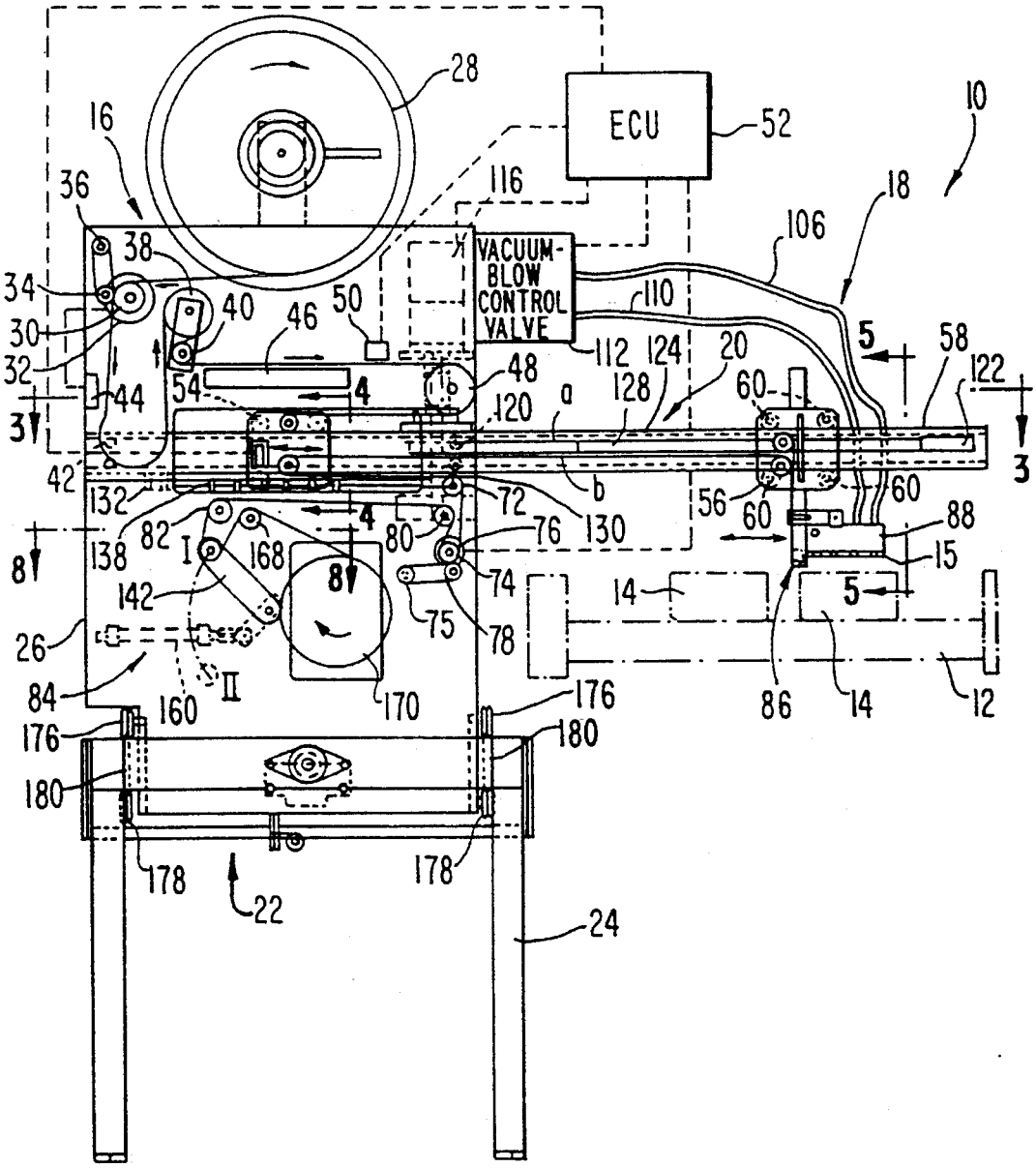
FIG. 1 is a front elevation of the high speed labeling machine of the present invention.

Referring to FIG. 1, there is shown the high speed labeling machine of the present invention indicated generally at 10 as used with a conveyor 12 for conveying various items or articles 14 to the labeling machine 10 for the application of labels 15. Labeling machine 10 generally includes a supply station 16 positioned adjacent conveyor 12, a dispensing and applying station 18 positioned a spaced distance from supply station 16 above conveyor 12 and articles 14, and a positioning device indicated at 20 for permitting transverse movement between supply station 16 and dispensing and applying station 18 thereby permitting high speed, accurate and reliable labeling. Labeling machine 10 may also include a longitudinal positioning device 22 for moving supply station 16 along conveyor 12 parallel to the feed path of articles 14.

Supply station 16 of labeling machine 10 includes a lower frame 24 positioned to support an upper supporting structure 26. A supply roll 28 of labels affixed to a continuous web of backing material is rotatably mounted on top of structure 26. A power unwind roller 30 is mounted on the driving shaft of a motor 32 for rotating the roller 30. A nip roller 34 is biased by a spring 36 into contact with the outer circumferential surface of roller 30 creating a nip or line of contact. Unwind roller 30 and nip roller 34 are positioned to receive the web from supply roll 28 and direct the web through the nip downwardly for delivery to the dispensing and applying station 18. Rotation of unwind roller 30 in the counterclockwise direction as shown in FIG. 1 causes unwind roller 30 and nip roller 34 to pull the continuous web of material from roll 28.

A pair of idler rollers 38 and 40 are positioned adjacent unwind roller 30 for directing the web toward the dispensing and applying station 18. The positioning of idler rollers 38 and 40 requires the web to turn upwardly to form a supply loop 42 of web between roller 30 and idler rollers 38 and 40. Power unwind roller 30 and supply loop 42 insure that a sufficient supply of labels are available to the dispensing and applying station 18 without requiring the web to be pulled directly from the supply roll 28 each time the web is moved or indexed through the labeling machine. A proximity sensor 44 may be used to sense the position of loop 42 so as to energize motor 32 when the lower portion of loop 42 rises above sensor 44 indicating a need for additional webbing.

An in-feed tension control vacuum grid 46 is positioned adjacent idler roller 40 so that the web exiting idler roller 40 passes adjacent to the top surface of vacuum grid 46. An idler roller 48 is positioned at the forward end of supporting structure 26 for redirecting the web from the vacuum grid 46 back inwardly toward loop 42. A photoelectric sensor 50 is positioned adjacent the web between vacuum grid 46 and idler roller 48. Sensor 50 is capable of sensing the gaps formed between the labels positioned on the web of backing material. Vacuum grid 46 creates enough tension in the web passing by sensor 50 by drawing the web downwardly toward the top surface of the grid so as to insure that the web remains taut as it passes by sensor 50, thereby avoiding aberrations in the signals from sensor 50 due to slack in the web. Signals from sensor 50 are fed to an electronic control unit 52 which controls various components of the labeling machine as described in more detail hereinbelow.

The positioning device 20 which receives the web from idler 48 includes a follower carriage 54, a support carriage 56 and a support arm 58 as best shown in FIGS. 1, 3A, 3B, 4 and 5. Follower carriage 54 and support carriage 56 include a front plate 55 and 57, respectively, having a generally rectangular shape. Wheel 60 is mounted in each corner of each front plate 55 and 57 of the respective carriage for movably mounting the carriage to support arm 58. Support arm 58 is rigidly attached to supporting structure 26 and includes a beam 59 and an elongated housing 61 connected to beam 59 both extending the width of supporting structure 26 outwardly adjacent the outer edge of conveyor 12. Each wheel 60 includes a V-groove designed for engaging a complementary ridge 62 formed along the upper and lower longitudinal edges of beam 59. In this manner, both follower carriage 54 and support carriage 56 are capable of moving along support arm 58 transverse to the feed path of articles 14 on conveyor 12. Follower carriage 54 includes an upper roller 64 for receiving the web from idler roller 48 and redirecting the web towards support carriage 56. Support carriage 56 also includes an upper roller 66 for receiving the web from upper roller 64 and directing the web downwardly to the dispensing and applying station 18. Likewise, support carriage 56 and follower carriage 54 each include a lower roller 68 and 70, respectively. Lower roller 68 receives the web of backing material without the labels attached thereto from the dispensing and applying station 18 and directs the web transversely across the conveyor toward supply station 16. Lower roller 70 of follower carriage 54 receives the web from lower roller 68 of support carriage 56 and directs the web back outwardly along support arm 58 toward conveyor 12. An idler roller 72 mounted on structure 26 receives the web from lower roller 70 and directs the web downwardly toward a driver roller 74.

Driver roller 74 is operated by a stepper motor 76 controlled by ECU 52 so as to rotate and pull the web through the nip formed between roller 74 and a nip roller 78 biased against roller 74 by a spring 75. An idler roller 80 mounted on structure 26 receives the web from roller 74 and directs the web inwardly to another idler roller 82. A take-up assembly 84 receives the web from idler roller 82 and maintains a tension in the web traveling from dispensing and applying station 18 as described more fully hereinbelow.

Referring to FIGS. 1, 5, 6 and 7, dispensing and applying station 18 includes a dispensing device in the form of a peeler bar assembly 86 and a vacuum-blow applicator 88. Peeler bar assembly 86 includes a peeler bar 90 attached to the end of a support bracket 91 extending vertically upwardly adjacent support arm 58. Support bracket 91 is adjustably mounted on support arm 58 to allow the vertical distance between peeler bar assembly 86 and articles 14 to be varied depending on the height of the articles. Peeler bar 90 includes a peeling edge against which the web is moved to separate the label from the web of backing material. Peeler bar assembly 86 also includes an alignment roller 94 rotatably mounted at each end on support bracket 91 for directing the web from lower roller 68 of support carriage 56 towards peeling edge 92 of peeler bar 90. A rotatable reduction roller 96 mounted at each end on support bracket 91 and positioned immediately adjacent the portion of the web exiting peeling edge 92 is positioned to receive the exiting portion of the web to minimize the frictional forces on the web as it is pulled over the peeling edge 92 and bar 90 thereby minimizing the required tension in the web necessary to effectively dispense a label. An idler roller 98 mounted on support bracket 91 positioned adjacent reduction roller 96 receives the web and directs it upwardly along support bracket 91 for engagement by lower roller 68 of support carriage 56.

Vacuum blow applicator 88 may be any conventional vacuum blow applicator device and may include a housing 100 having a lower surface 102 facing conveyor 12. Suction openings (not shown) formed in lower surface 102 communicate with a source of vacuum pressure via a flexible hose 106 connected to housing 100. Also, air passages (not shown) formed in housing 100 open at lower surface 102 for supplying relatively high pressure air to lower surface 102 for blowing the label onto article 14. Pressurized air is supplied to air passages via a flexible supply hose 110 connected to the housing 100. Vacuum hose 106 and supply hose 110 are each connected to a vacuum-blow control valve, i.e. a 4-way, 2-position solenoid operated spring biased valve, which operates based on signals from ECU 52 to alternate between supplying air through hose 110 for blowing labels onto articles 14 and creating a vacuum at lower surface 102 via hose 106 for acquiring labels dispensed from peeler bar 90.

Figure 2:
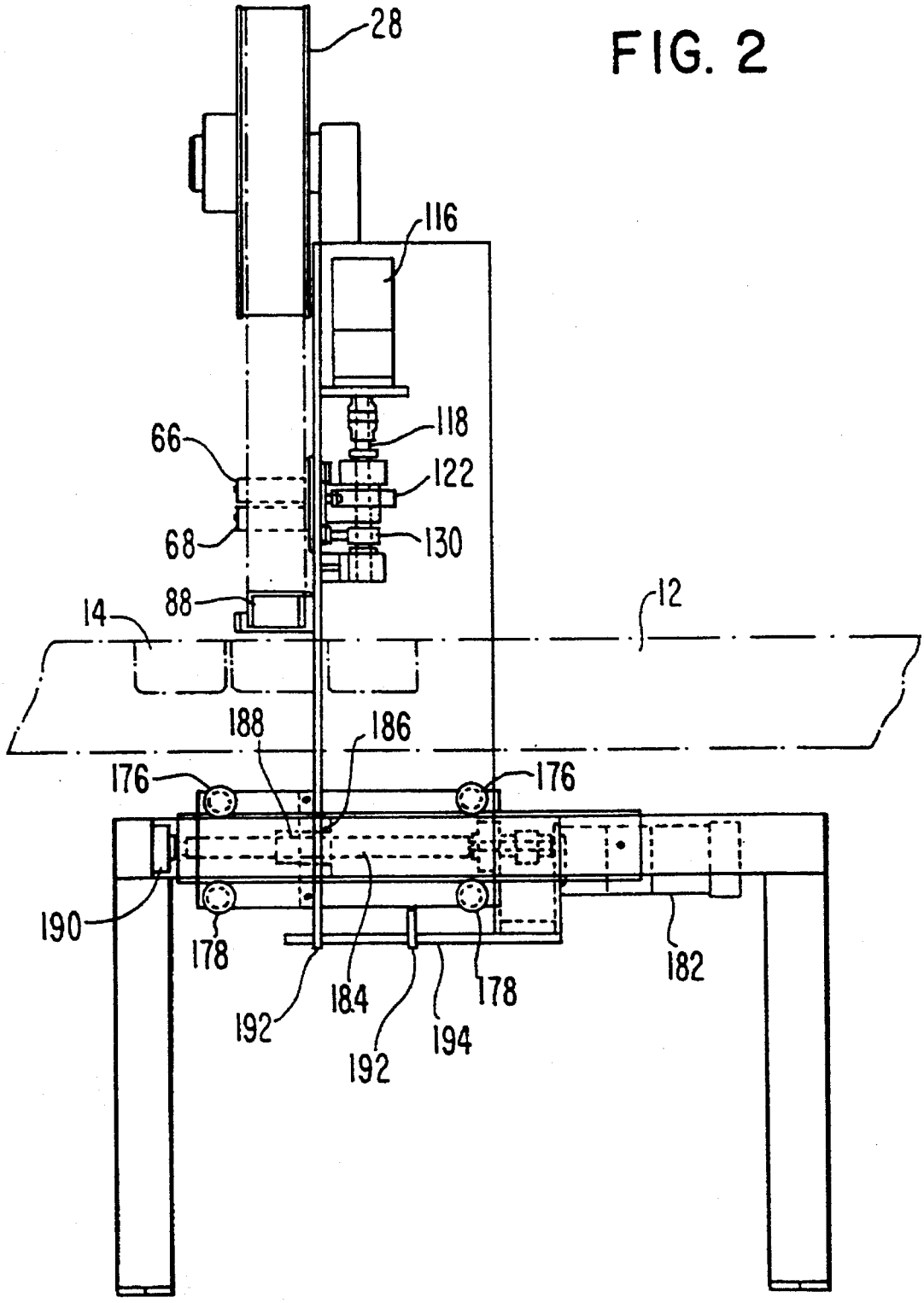
FIG. 2 is a side elevation of the labeling machine of FIG. 1.

As shown in FIGS. 1 and 2, positioning device 20 also includes a carriage driving device 114 for moving follower carriage 54 and support carriage 56 along support arm 58 transverse to the feed path of articles 14. Carriage driving device 114 includes a stepper motor 116 and associated rotatable shaft 118 mounted vertically on structure 26 so that shaft 118 extends downwardly through elongated housing 61 of support arm 58. As best shown in FIGS. 2, **3*a* and 3*b*, large driving roller 120 is rigidly connected to shaft 118 and positioned at least partially within elongated housing 61. A large idler roller 122 having the same diameter as roller 120 is positioned in alignment with roller 120 at the most outward end of support arm 58 and at least partially within elongated housing 61. A large timing belt 124 is positioned around rollers 120 and 122 so that rotation of roller 120 moves large timing belt 124. Support carriage 56 includes two cylindrical extensions 125 extending from front plate 57 through an elongated slot 128 formed in beam and the adjacent wall of elongated housing 61. Extensions 125 also extend through large timing belt 124 to engage two fasteners for securely connecting support carriage 56 to large timing belt 124. As a result, support carriage 56 is capable of moving back and forth along support arm 58 with large timing belt 124 as determined by the operation of stepper motor 116**.

Figure 3A:
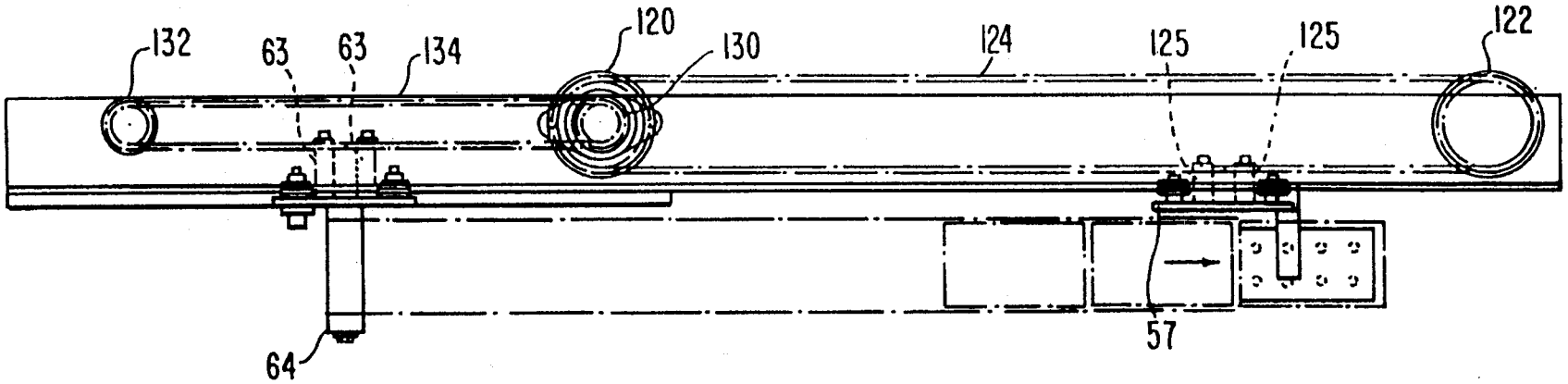
FIG. 3*a* is a top plan view of the positioning device of the present invention taken along plane 3—3 of FIG. 1.
Figure 3B:
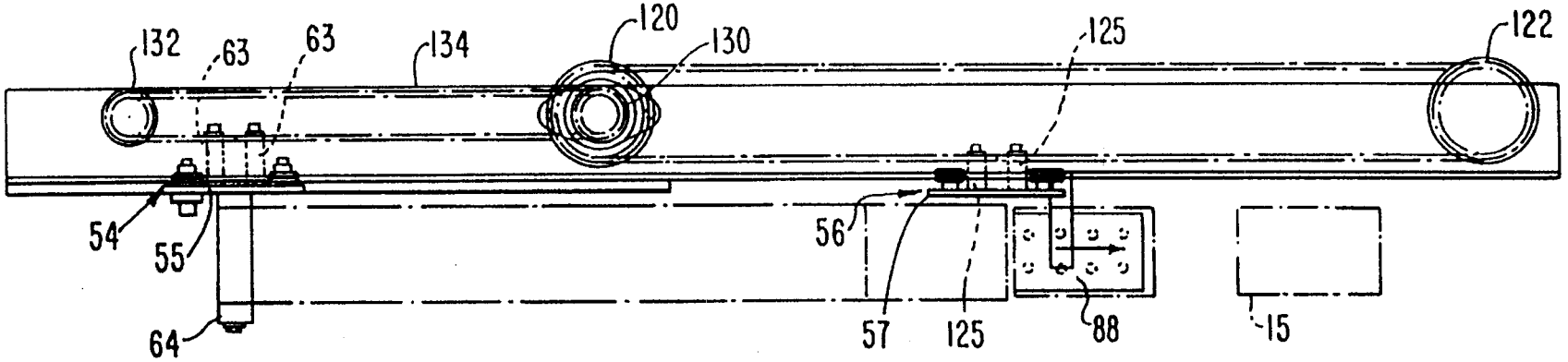
FIG. 3*b* is a top plan view of the positioning device as in FIG. 3*a* except with the follower carriage and support carriage shifted transversely.
Figure 5:
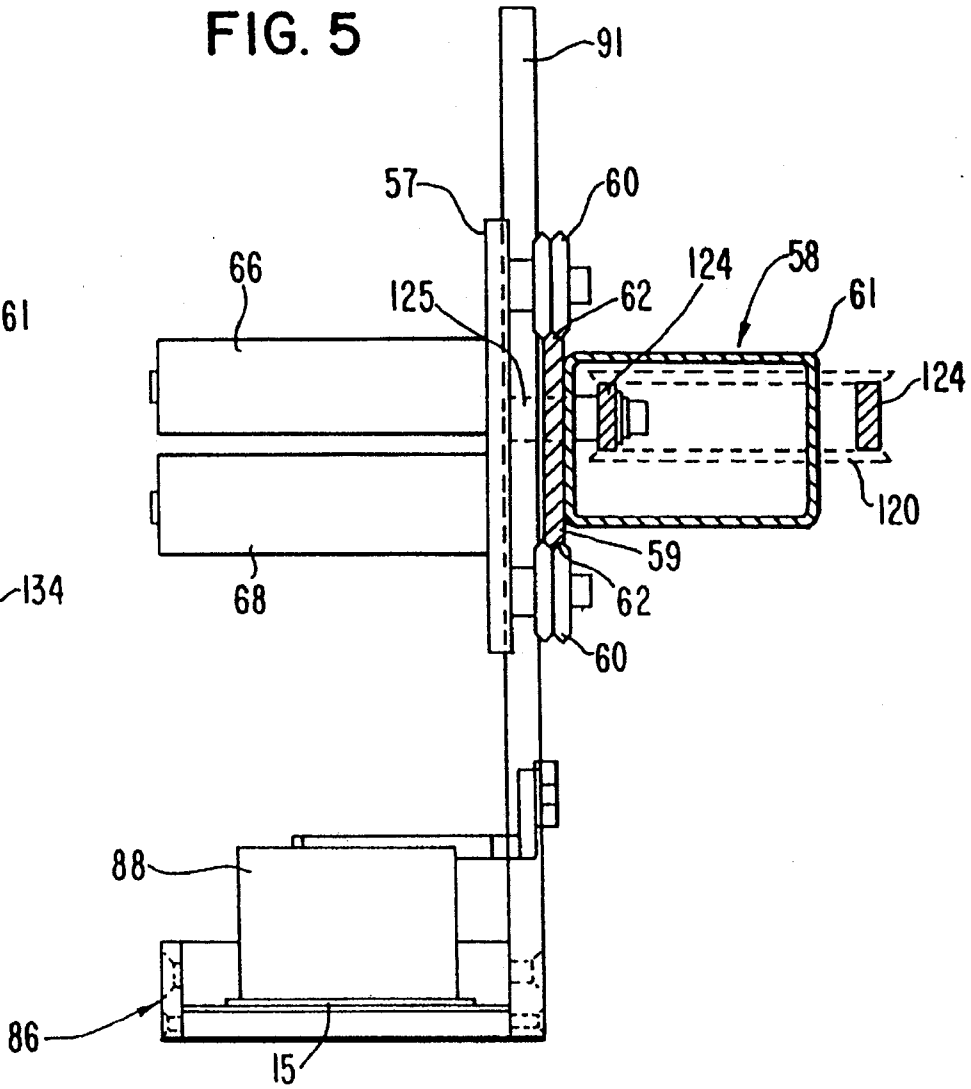
FIG. 5 is a cross-sectional view of the support arm taken along plane 5—5 in FIG. 1 showing the support carriage and respective timing belt.
Figure 4:
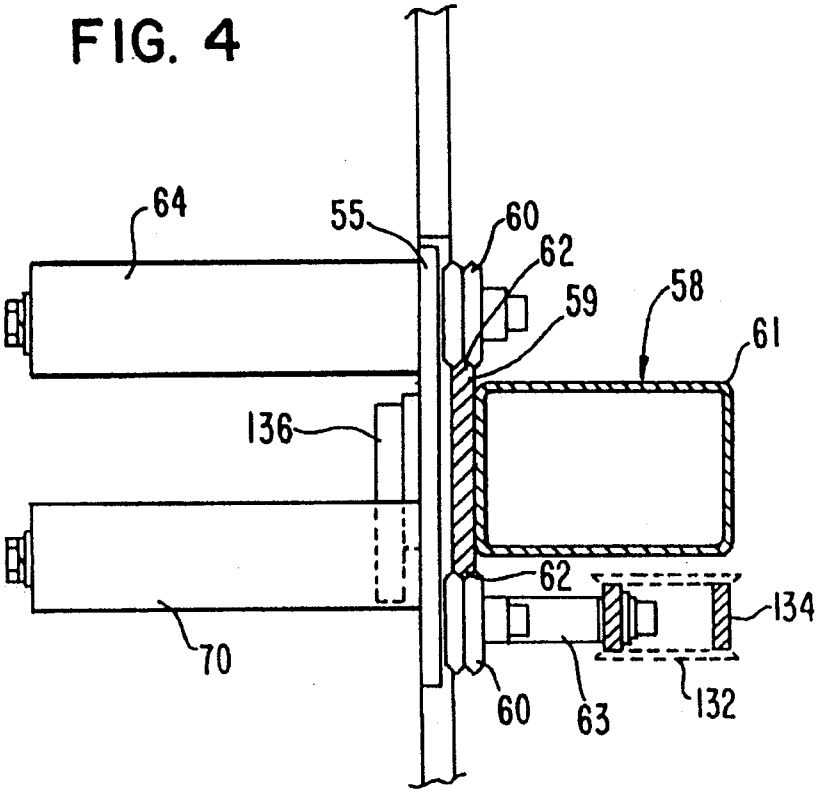
FIG. 4 is a cross-sectional view of the support arm taken along plane 4—4 in FIG. 1 showing the follower carriage and respective timing belt.
Figure 7:
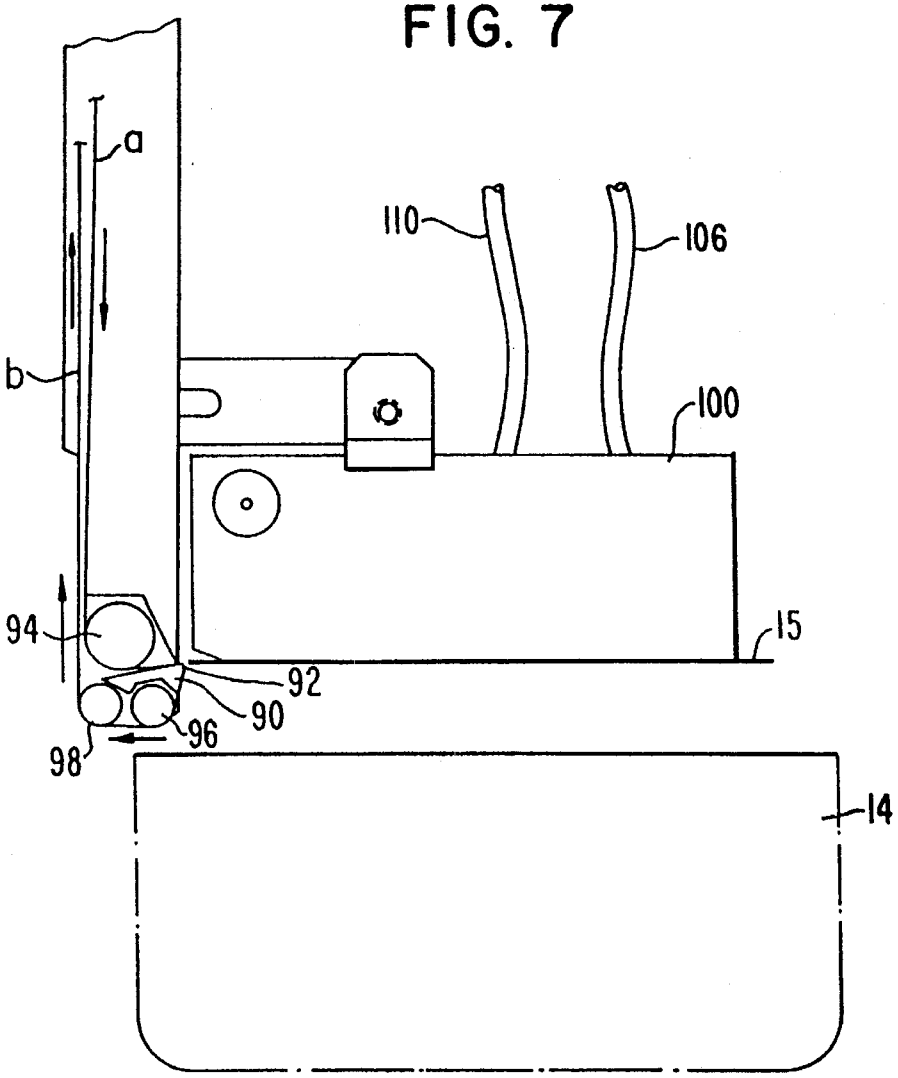
FIG. 7 is an enlarged elevation of the peeler bar assembly and vacuum-blow applicator with a label dispensed and positioned on the applicator prior to blowing onto the article.
Figure 6:
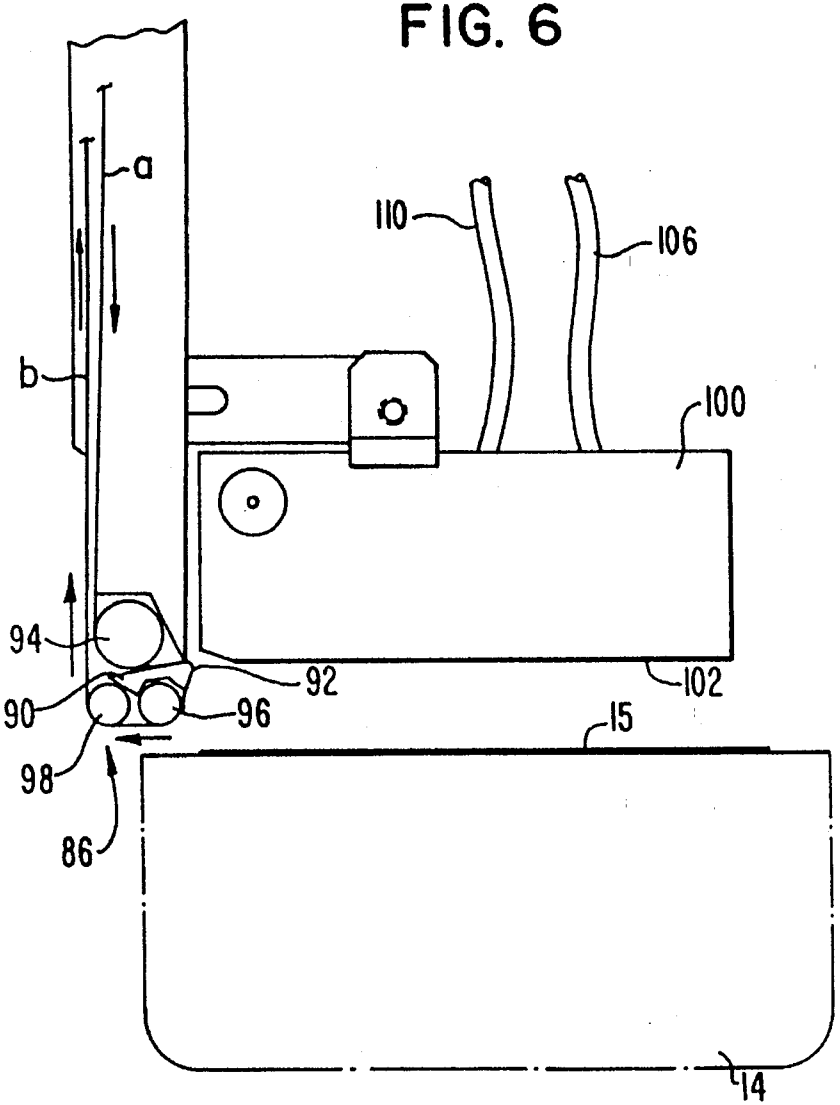
FIG. 6 is an enlarged elevation of the peeler bar assembly and vacuum-blow applicator immediately after applying a label to an article.

Follower carriage 54 is also operatively attached to rotating shaft 118 by a separate smaller driving roller 130 connected to an equal sized idler roller 132 by a small timing belt 134. Small driving roller 130 and idler roller 132 are positioned at opposite sides of supporting structure 26 below and parallel to support arm 58 adjacent follower carriage 54. As shown in FIGS. 3B and 4, two cylindrical extensions 63 extend from front plate 55 of follower carriage 54 below beam 59 between lower wheels 60 and through small timing belt 134 for securely engaging timing belt 134 with, for example, a nut and bolt connection. In this manner, follower carriage 54 is moved by timing belt 134 along the same positioning path as support carriage 56 transverse to the feed path of articles 14. However, the diameters of small driving roller 130 and the small idler roller 132 are one-half the diameter of large driving roller 120 and large idler roller 122. As a result, small timing belt 134 and follower carriage 54 move at half the speed of large timing belt 124 and support carriage 56. Thus, for any given degree of rotation of rotatable shaft 118, follower carriage 54 moves linearly along support arm 58 one-half the distance moved by support carriage 56. In this manner, follower carriage 54 is able to maintain relatively constant tension in web portions a and b extending to and from support carriage 56 as support carriage 56 moves transversely across conveyor 12. This design allows the dispensing and applying station 18 to be moved relative to the supply station 16 so as to vary the distance between stations 16 and 18 while preventing both unwanted slack and overtight conditions in web portions a and b. As support carriage 56 moves to the right in FIG. 1, follower carriage 54 will follow at half the speed. Because follower carriage 54 uses upper roller 64 to redirect the web 180° toward support carriage 56 and a second lower roller 70 to redirect the scrap web traveling from peeler bar assembly 86 180° back towards support carriage 56, creating four parallel lengths of web, follower carriage 54 need only move half the distance to compensate for the movement of support carriage 56 in either direction to feed out or pull in the appropriate amount of web as support carriage moves along support arm 58. Moreover, peeler bar assembly 86 and vacuum-blow applicator 88 can be moved relative to supply station 16 transversely across conveyor 12 without dispensing labels since positioning device 20 utilizes follower carriage 54 to maintain relatively constant tension in webs a and b, thereby avoiding movement of the web relative to peeler bar 90 unless such is desired by energizing driver roller 74.

A proximity sensor 136 is mounted on the front surface of the front plate of follower carriage 54 so that the sensor faces downwardly toward lower frame 24. A series of set collars 138 are mounted on, and intermittently spaced along, a rod 140. Rod 140 is fixedly mounted on supporting structure 26 while set collars 138 are adjustably mounted and, therefore, can be repositioned along the length of rod 140. Set collars 138 function as flags or markers for proximity sensor 136 marking the equivalent position of articles 14 on conveyor 12. Proximity sensor 136 senses the position of a set collar 138 passing immediately adjacent sensor 136 as follower carriage 54 moves along support arm 58. Since the driving ratio of support carriage 56 to follower carriage 54 is 2:1, whenever support carriage 56 and, therefore, vacuum blow applicator 88 moves a given distance from one article to another transversely across conveyor 12, follower carriage 54 only moves one-half the distance. In this manner, set collars 138 can be positioned along rod 140 to correspond to the transverse position of articles 14 on conveyor 12. Upon sensing a set collar 138, proximity sensor 136 sends a signal to ECU 52 which actuates solenoid valve 112 to move from a vacuum position creating a vacuum at applicator 88 to a blowing position allowing pressurized air to flow through supply hose 110 and housing 100, thereby forcing a label positioned on lower surface 102 of housing 100 downwardly onto article 14. Therefore, each time proximity sensor 136 passes by a set collar 138, solenoid valve 112 is actuated to allow vacuum-blow applicator 88 to blow a label onto article 14. However, note that ECU 52 may be programmed to ignore one or more of the signals from proximity sensor 136 so as to allow support carriage 56 to move transverse to conveyor 12 without solenoid valve 112 cycling. Moreover, even if solenoid valve 112 does cycle between vacuum and blow positions during movement of vacuum-blow applicator 88 when no labeling is required, no labeling will occur unless stepper motor 76 is controlled by ECU 52 to rotate driver roller 74 and index the web through the labeling machine.

Figure 8:
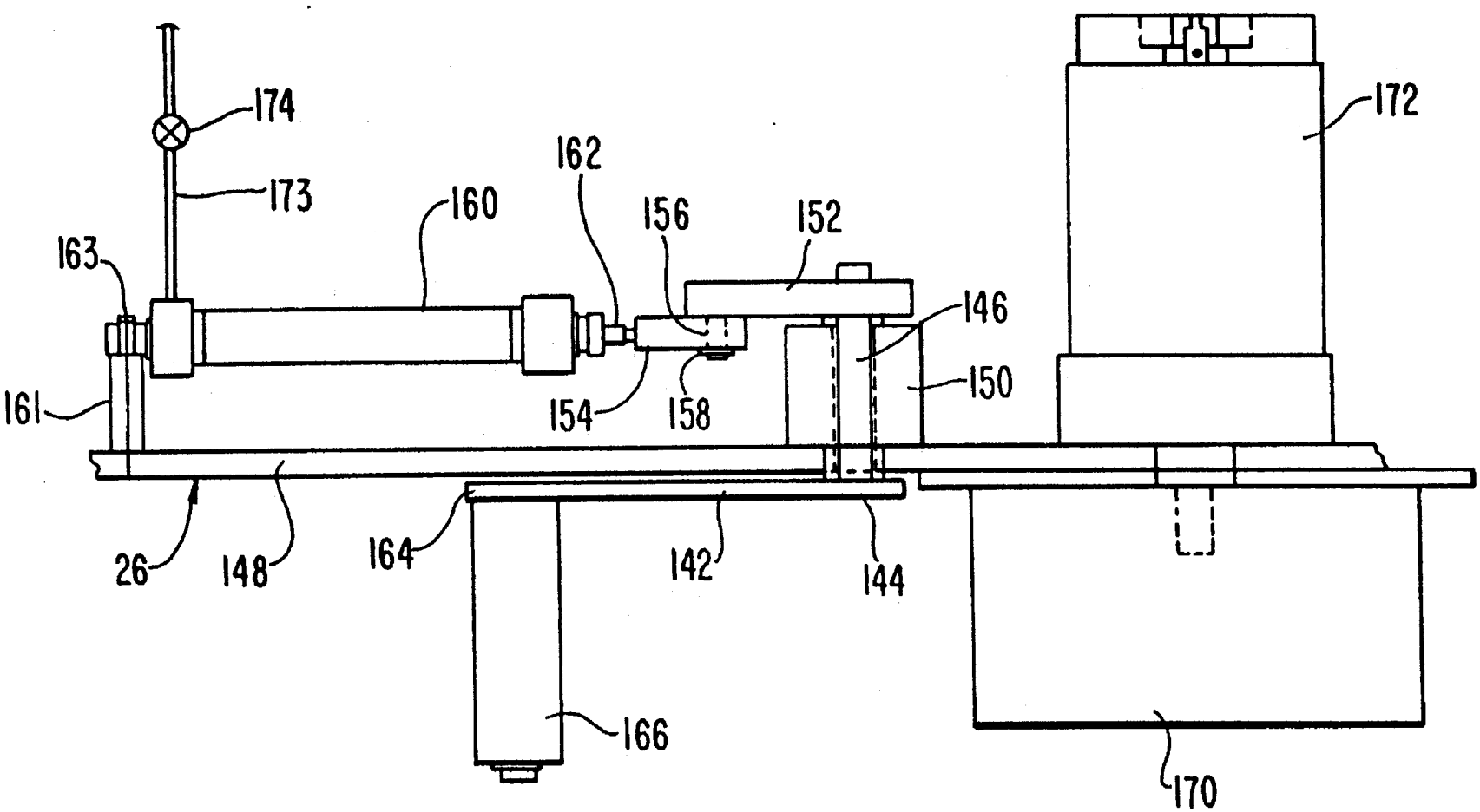
FIG. 8 is a top plan view of the tensioning device of the present invention taken along plane 8—8 of FIG. 1.

Referring to FIGS. 1 and 8, take-up assembly 84 includes a pivotable take-up link 142 rotatably mounted at a fixed end 144 to supporting structure 26 by a pin 146. Pin 146 extends through a support wall 148 of supporting structure 26 and through the center of a spacer collar 150. Pin 146 extends outwardly from spacer collar 150 to connect with a pivotable bar 152 extending parallel to pivotable take-up link 142 on the opposite side of support wall 148. As shown in FIG. 1, bar 152 extends outwardly from pin 146 approximately perpendicular to take-up link 142. Moreover, bar 152 and take-up link 142 are both rigidly attached to pin 146 so that movement of either bar 152 or link 142 causes corresponding movement of the other. The outward end of bar 152 includes an extension pin 156 which extends laterally outward through a hole formed in a connector piece 154 to pivotably attach connector piece 154 to bar 152. Any suitable conventional fastening device which permits rotation between bar 152 and connector 154, such as a snap ring 158, may be used to secure the end of pin 156. An air cylinder 160 mounted at one end to support wall 148 by a bracket 161 and bolt 163 includes a rod 162 slidably mounted in cylinder 160 and extending outwardly from one end of cylinder 160 to contact connector 154.

Take-up link 142 also includes a pivotable end 164 having a link roller 166 connected thereto and extending outwardly for supporting the web received from idler roller 82. Another idler roller 168 mounted on structure 26 is positioned adjacent idler roller 82 to receive the web from link roller 166 and direct the web toward a take-up drum 170. Take-up drum 170 is mounted on a rotatable shaft of a motor 172 which operates to rotate drum 170 in the clockwise direction as shown in FIG. 1 for accumulating the waste backing material into a roll. Motor 172 is intermittently operated depending on the position of pivotable take-up link 142. As shown in FIG. 1, when take-up link 142 is in the upper position indicated by I, motor 172 is off. As the web is indexed through the labeling machine as dictated by the operation of stepper motor 76 and driver roller 74, the take-up link 142 moves from the upper position I pivotally downwardly to a lower position II. When link 142 reaches lower position II a limit switch (not shown) activates motor 172 to begin rotating take-up drum 170 causing link 142 to pivot upwardly back into the upper position I at which time take-up drum 170 stops rotating. Therefore, take-up link 142 avoids the need to continuously operate take-up drum 170 or, alternatively, to cycle drive drum 170 each time the web is indexed through driver roller 74. The air pressure supplied to air cylinder 160 via supply 173 may be varied by, for example, a flow control valve 174, to control the force applied by rod 162 on connector 154. The outward force of rod 162 against connector 154 acts through bar 152 and pin 146 to bias take-up link 142 toward the lower position II thus maintaining a desired tension in the web extending from driver roller 74. Also, by maintaining tension in the web downstream of driver roller 74, take-up assembly 84 inherently assists driver roller 74 in pulling the web through the label machine thereby reducing the torque requirements of stepper motor 76.

The dispensing end applying station 18 may also be moved longitudinally along conveyor 12 to enable the labeling machine to label any variety of arrangements or arrays of articles on conveyor 12. Labeling machine 10 may be provided with a longitudinal positioning device 22 for moving supporting structure 26 and supply station 16 parallel to conveyor 12. As shown in FIGS. 1 and 2, positioning device 22 includes an upper V-groove wheel 176 and a lower V-groove wheel 178 attached to the lower portion of supporting structure 26 at each corner. A beam 180 is attached to each side of lower frame 24 adjacent supporting structure 26. Each beam 180 extends along lower frame 24 parallel to conveyor 12 and includes upper and lower edges for engagement by the V-grooves of wheels 176 and 178. In this manner, supporting structure 26 and the entire supply station 16 is movably mounted in a direction parallel to the feed path of articles 14 on lower frame 24. A motor 182 and corresponding threaded shaft 184 are mounted on lower frame 24 between beams 180. A hub 186 rigidly attached to supporting structure 26 includes an internal cavity 188 having threads complementary to the outer threads of shaft 184. The end of shaft 184 opposite motor 182 is rotatably supported in a beating 190 mounted on lower frame 24. Motor 182 may be actuated by a signal from ECU 52 to rotate shaft 184 in either direction causing corresponding movement of supply station 16 along conveyor 12.

During operation, ECU 52 controls stepper motor 116 to move dispensing and applying station 18 along a positioning path transverse to the feed path of articles 14 on conveyor 12. ECU 52 may also control motor 182 to move the supply station parallel to conveyor 12 causing the dispensing and applying station 18 to move along a positioning path parallel to conveyor 12. Also, stepper motor 116 and motor 182 may be operating simultaneously to move peeler bar assembly 86 and vacuum-blow applicator 88 through a variety of positioning paths above conveyor 12 enabling labeling machine 10 to effectively and efficiently label articles oriented in a variety of arrangements and arrays.

During movement of support carriage 56, vacuum-blow applicator 88 blows a label from lower surface 102 onto article 14. After the blowing of the label is completed, solenoid valve 112 immediately returns to the vacuum position. As support carriage 56 continues to move towards the next article to be labeled, ECU 52 activates stepper motor 76 which rotates to pull the web through peeler bar assembly 86 causing a label to be dispensed as the web bends over peeling edge 92. This indexing of web material continues until photoelectric sensor 50 senses the gap between the next adjacent labels at which time sensor 50 signals ECU 52 which, in turn, stops stepper motor 76. This design permits accurate control over the sequential dispensing of labels. As peeler bar assembly 86 and vacuum-blow applicator 88 continue to move toward the next article, the dispensed label is sucked against lower surface 102 of vacuum-blow applicator 88. When proximity sensor 136, moving along support arm 58 on follower carriage 54, senses the next set collar 138, ECU 52 actuates solenoid valve 112 which moves into a blowing position allowing pressurized air to flow through supply hose 110 through the passages (not shown) formed in housing 100 forcing the label downwardly onto article 14. As support carriage 56 continues to move towards the next article, solenoid valve 112 is moved back into a vacuum position which creates a vacuum at lower surface 102. At approximately the same time, stepper motor 76 is operated to rotate driver roller 74 to pull the web across peeler bar assembly 86 again until photoelectric sensor 50 senses the gap between the next adjacent labels passing by the sensor at which time the sensor signals ECU 52 to stop sensor motor 76, thus, dispensing another label.

The longitudinal positioning device 22 may include proximity sensors 192 positioned on an extension arm 194 mounted on lower frame 24 below supporting structure 26. Flags or markers (not shown) adjustably mounted along the lower portion of supporting structure 26 may be used to mark the various positions of supply stations 16 so that sensors 192 can function to accurately signal ECU 52 to stop motor 182 when supply station 16 is in the proper longitudinal position along conveyor 12.

One important advantage of the present invention is that the dispensing and applying station 18 can be quickly and accurately moved into an applying position adjacent each article to be labeled without requiring the supply roll 28, driver roller 74, take up drum 170 and other components of the supply station 16 to be mounted on the movable support carriage 56. The present invention permits movement between the supply station 16 and dispensing and applying station 18 by providing the positioning device 20 which is designed to maintain the proper amount of tension in the continuous web of material throughout the movement of the dispensing and applying station 18 relative to the supply station 18. By positioning supply station 16 adjacent conveyor 12 while permitting dispensing and applying station 18 to move transversely across conveyor 12 while being fed a continuous web of backing material, the present invention provides a lightweight, high speed, transversely movable dispensing and applying station which minimizes the time and distance necessary for the station to dispense and apply each label. Since each label is not dispensed until immediately before the vacuum-blow applicator 88 reaches an applying position and therefore each label is dispensed in close proximity to the article to be labeled, the present invention minimizes the time and traversing distance of handling the fragile and sticky dispensed label thereby minimizing the opportunity for error and inadvertent movement of the label before application to the article. Moreover, the present invention minimizes the weight and size of the movable and dispensing and applicator assembly thereby minimizing the negative effects of inertia in controlling the movement of station 18 while also minimizing the requirements and costs of the supporting structure and control components.

INDUSTRIAL APPLICABILITY

The disclosed high speed labeling machine for dispensing labels from a continuous web of material and applying the labels to various items or articles finds particular utility when positioned along a conveyor as a labeling station in a manufacturing, distribution, or packaging application. The high speed labeling machine of the present invention is especially useful in labeling articles positioned in a variety of side-by-side arrangements both transversely and longitudinally along the conveyor.

We claim:

1. A labeling machine for dispensing labels from a continuous web of material and applying the labels to a plurality of articles moving relative to the labeling machine along a predetermined feed path comprising:

a supply means for providing a supply of the continuous web of material having the labels affixed thereto;

a driving means for moving the continuous web of material from said supply means through the labeling machine;

a movable dispensing means positioned a spaced distance from said supply means for receiving the continuous web of material from said supply means and removing a label from the continuous web of material for application to the article;

a positioning means for automatically moving said dispensing means along a first positioning path during operation of the labeling machine into a plurality of applying positions adjacent the articles for applying the labels to the articles, said positioning means including a support arm extending from the labeling machine along said positioning path to said predetermined feed path, a follower carriage movably mounted on said support arm adjacent said supply means, and a support carriage mounted on said support arm for movement along said positioning path, said dispensing means mounted on said support carriage;

wherein said positioning means is operable to automatically move said movable dispensing means into said plurality of applying positions during operation of the labeling machine to vary said spaced distance between said supply means and said movable dispensing means while maintaining tension in the continuous web necessary to permit effective dispensing of the labels.

2. The label machine of claim 1, further including an applicator means positioned adjacent said dispensing means for applying the label dispensed from said dispensing means to the article, wherein said applicator means is connected to said dispensing means, said movement of said dispensing means by said positioning means causing movement of said applicator means.

3. The label machine of claim 2 wherein said positioning means is capable of moving said dispensing means and said applicator means along said first positioning path substantially transverse to said predetermined feed path of the articles.

4. The label machine of claim 3, wherein said supply means includes a supply station located a spaced transverse distance from said predetermined feed path and a supply roll of the continuous web of material positioned at said supply station, said applicator means being mounted on said support carriage.

5. The label machine of claim 4, wherein said dispensing means includes a peeler bar positioned adjacent said applicator means.

6. The label machine of claim 5, wherein said positioning means is operable to move said support carriage a first distance along said first positioning path and said follower carriage a second distance along said first positioning path, said second distance being less than said first distance.

7. The label machine of claim 6, wherein said second distance is one-half of said first distance.

8. The label machine of claim 1, further including a take-up means for accumulating the continuous web of material downstream of said driving means, said take-up means including a pivotable link having a first end pivotal between a first position and a second position and a second end spaced from said first end, said first end including a link roller for supporting said web, said take-up means including a biasing means for applying a biasing force to said pivotable link to bias said first end toward said second position to maintain tension in the continuous web of material, said take-up means further including a take-up drum for receiving the continuous web of material from said dispensing means and said link roller and operable to move said first end of said pivotable link from said second position to said first position.

9. The labeling machine of claim 1, wherein said dispensing means further includes a peeler bar and movement of said continuous web of material across said peeler bar causes dispensing of a label from said continuous web of material, said positioning means capable of automatically moving said movable dispensing means into said plurality of applying positions during operation of the labeling machine to significantly vary said spaced distance between said supply means and said dispensing means while preventing the said movement of said continuous web of material across said peeler bar to prevent dispensing of a label.

10. The label machine of claim 2, wherein said applicator means includes a vacuum-blow applicator assembly.

11. The label machine of claim 2, wherein said dispensing means dispenses labels to said applicator means while said applicator means is moved by said positioned.

12. The label machine of claim 2, wherein said dispensing means includes a peeler bar positioned adjacent said applicator means, said peeler bar includes a peeling edge for contacting the continuous web of material so as to dispense the label from the continuous web of material, the continuous web of material including an entering portion moving towards said peeling edge immediately adjacent said peeling edge and an exiting portion moving away from said peeling edge immediately adjacent said peeling edge, said peeler bar further including a rotatable roller positioned immediately adjacent said peeler bar between said peeler bar and said exiting portion of the continuous web for supporting said exiting portion.

13. The label machine of claim 4 wherein said driving means is positioned adjacent said supply station for receiving the continuous web of material from said dispensing means, said driving means including a driver roller and a nip roller biased toward said driver roller, the continuous web of material extending between said driver roller and said nip roller.

14. The label machine of claim 4 wherein said positioning means is operable to move said support arm along a second positioning path substantially parallel to said predetermined feed path.

15. The label machine of claim 14, wherein said positioning means is operable to move said dispensing means and said applicator means along said first positioning path while simultaneously moving said support arm along said second positioning path.

16. A labeling machine for dispensing labels from a continuous web of material and applying the labels to a plurality of articles comprising:

a supply means for providing a supply of the continuous web of material having the labels affixed thereto;

a driving means for pulling the continuous web of material from said supply means;

a dispensing means for removing a label from the continuous web of material for application to the article;

an applicator means positioned adjacent said dispensing means for applying the label dispensed from said dispensing means to the article;

a positioning means for automatically, sequentially positioning said dispensing means during operation of the labeling machine in a plurality of applying positions adjacent the plurality of articles for applying the labels to the plurality of articles wherein the plurality of articles move relative to the labeling machine along a predetermined feed path, said positioning means capable of automatically, sequentially positioning said dispensing means in said plurality of applying positions during operation of the labeling machine by moving said dispensing means along a first positioning path substantially transverse to said predetermined feed path and along a second positioning path substantially parallel to said predetermined feed path, wherein said supply means includes a supply station located a spaced transverse distance from said predetermined feed path and a supply roll of the continuous web of material positioned at said supply station, and further including a support arm extending from the label machine adjacent said supply roll along said positioning path to said predetermined feed path, said positioning means including a support carriage mounted on said support arm for movement along said first positioning path, said dispensing means and said applicator means mounted on said support carriage, said dispensing means including a peeler-bar positioned adjacent said applicator means and said positioning means including a follower carriage movably mounted on said support arm at said supply station.

17. The labeling machine of claim 16, wherein said applicator means is connected to said dispensing means, said movement of said dispensing means by said positioning means causing movement of said applicator means.

18. The labeling machine of claim 17, wherein movement of said dispensing means and said applicator means by said positioning means during operation of the labeling machine causes said dispensing means and said applicator means to move relative to said supply means.

19. The label machine of claim 16, wherein said positioning means is operable to move said support carriage a first distance along said first positioning path and said follower carriage a second distance along said first positioning path, said second distance being less than said first distance.

20. The label machine of claim 19, wherein said second distance is one-half of said first distance.

21. The label machine of claim 20, wherein said applicator means includes a vacuum-blow applicator assembly.

22. The labeling machine of claim 16, further including a support frame movably positioned at said supply station for supporting said supply means and said support arm, said positioning means operatively connected to said support frame and capable of automatically moving said support frame and said support arm along said second positioning path during operation of the labeling machine for positioning said dispensing means in said plurality of applying positions.

23. A labeling machine for dispensing labels from a continuous web of material and applying the labels to a plurality of articles, comprising:

a supply means for providing a supply of the continuous web of material having the labels affixed thereto;

a driving means for pulling the continuous web of material from said supply means;

a dispensing means for removing a label from the continuous web of material for application to the article;

an applicator means positioned adjacent said dispensing means for applying the label dispensed from said dispensing means to the article;

a positioning means for moving said dispensing means during operation of the labeling machine into an applying position adjacent the article for applying the label to the article;

and a take-up means for accumulating the continuous web of material downstream of said driving means, said take-up means including a pivotable link extending along a longitudinal axis and including a first end pivotable between a first position and a second position and a second end spaced from the first end, said first end including a link roller for supporting the continuous web of material, said take up means including a pivotable bar connected to said pivotable link, said pivotable bar including a biased end positioned a spaced distance from said longitudinal axis of said pivotable link, said take-up means further including a biasing means connected to said biased end of said pivotable bar for applying a biasing force to said pivotable link to bias said first end toward second position to maintain tension in the continuous web of material.

24. The labeling machine of claim 23, wherein said take-up means further includes a take-up drum arranged to receive the continuous web of material from said link roller and operable to move said first end of said pivotable link from said second position to said first position.

25. The labeling machine of claim 24, wherein said dispensing means includes a peeler bar positioned adjacent said applicator means, said peeler bar including a peeling edge for contacting the continuous web of material to cause the label to dispense from the continuous web of material including an entering portion moving towards said peeling edge immediately adjacent said peeling edge and an exiting portion moving away from said peeling edge immediately adjacent said peeling edge, said peeler bar further including a rotatable roller positioned immediately adjacent said peeler bar between said peeler bar and said exiting portion of the continuous web for supporting said exiting portion.

26. A labeling machine for dispensing labels from a continuous web of material and applying the labels to a plurality of articles comprising:

a supply means for providing a supply of the continuous web of material having the labels affixed thereto;

a driving means for pulling the continuous web of material from said supply means;

a dispensing means for removing a label from the continuous web of material for application to the article;

an applicator means positioned adjacent said dispensing means for applying the label dispensed from said dispensing means to the article;

a positioning means for automatically, sequentially positioning said dispensing means during operation of the labeling machine in a plurality of applying positions adjacent the plurality of articles for applying the labels to the plurality of articles wherein the plurality of articles move relative to the labeling machine along a predetermined feed path, said positioning means capable of automatically, sequentially positioning said dispensing means in said plurality of applying positions during operation of the labeling machine by moving said dispensing means along a first positioning path substantially transverse to said predetermined feed path and along a second positioning path substantially parallel to said predetermined feed path, wherein said supply means includes a supply station located a spaced transverse distance from said predetermined feed path and a supply roll of the continuous web of material positioned at said supply station, and further including a support arm extending from the label machine adjacent said supply roll along said positioning path to said predetermined feed path, said first positioning means including a support carriage mounted on said support arm for movement along said first positioning path, said dispensing means and said applicator means mounted on said support carriage, further including a support frame movably positioned at said supply station for supporting said supply means and said support arm, said positioning means operatively connected to said support frame and capable of automatically moving said support frame and said support arm along said second positioning path during operation of the labeling machine for positioning said dispensing means in said plurality of applying positions.

* * * * *